US008302545B2

(12) United States Patent
Swanson et al.

(10) Patent No.: US 8,302,545 B2
(45) Date of Patent: Nov. 6, 2012

(54) SYSTEMS FOR STAGED COMBUSTION OF AIR AND FUEL

(75) Inventors: Larry William Swanson, Laguna Hills, CA (US); Roy Payne, Mission Viejo, CA (US); Quang H. Nguyen, Aliso Viejo, CA (US)

(73) Assignee: General Electric Company, Schenectady, NY (US)

( * ) Notice: Subject to any disclaimer, the term of this patent is extended or adjusted under 35 U.S.C. 154(b) by 274 days.

(21) Appl. No.: 12/389,995

(22) Filed: Feb. 20, 2009

(65) Prior Publication Data

US 2010/0212556 A1 Aug. 26, 2010

(51) Int. Cl.
*F23C 1/00* (2006.01)
*F23L 17/16* (2006.01)
*F23L 9/04* (2006.01)

(52) U.S. Cl. ..... 110/297; 110/261; 110/182.5; 431/10

(58) Field of Classification Search ..... 110/214, 110/297, 348, 182.5; 431/10, 12
See application file for complete search history.

(56) References Cited

U.S. PATENT DOCUMENTS

| | | | | |
|---|---|---|---|---|
| 5,368,471 | A * | 11/1994 | Kychakoff et al. | 431/12 |
| 5,727,480 | A * | 3/1998 | Garcia-Mallol | 110/203 |
| 6,085,674 | A | 7/2000 | Ashworth | |
| 6,258,336 | B1 | 7/2001 | Breen et al. | |
| 6,318,277 | B1 | 11/2001 | Kokkinos | |
| 6,325,002 | B1 | 12/2001 | Ashworth | |
| 6,325,003 | B1 | 12/2001 | Ashworth et al. | |
| 6,453,830 | B1 | 9/2002 | Zauderer | |
| 6,599,118 | B2 | 7/2003 | Pisupati | |
| 6,604,474 | B2 * | 8/2003 | Zamansky et al. | 110/342 |
| 6,790,030 | B2 | 9/2004 | Fischer et al. | |
| 6,865,994 | B2 * | 3/2005 | Seeker et al. | 110/345 |
| 7,004,086 | B2 | 2/2006 | Morrison et al. | |
| 7,047,891 | B2 | 5/2006 | Vatsky | |
| 2008/0083356 | A1 * | 4/2008 | Payne et al. | 110/297 |

FOREIGN PATENT DOCUMENTS

| | | | |
|---|---|---|---|
| WO | 99/08045 | A1 | 2/1999 |
| WO | 03/044434 | A1 | 5/2003 |
| WO | 2005/118113 | A1 | 12/2005 |

OTHER PUBLICATIONS

U.S. Appl. No. 12/036,739, Combustion Systems and Processes for Burning Fossil Fuel With Reduced Nitrogen Oxygen Emissions, David Moyeda, Feb. 25, 2008.
U.S. Appl. No. 12/036,722, Method and Apparatus for Staged Combustion of Air and Fuel, Thomas Roy Payne, Feb. 25, 2008.

* cited by examiner

*Primary Examiner* — Kenneth Rinehart
*Assistant Examiner* — David J Laux
(74) *Attorney, Agent, or Firm* — Armstrong Teasdale LLP

(57) ABSTRACT

A combustion system for combusting air and fuel includes a primary combustion zone configured to produce combustion gases from the air and the fuel and an intermediate air zone downstream from the primary combustion zone. The intermediate air zone is configured to inject an intermediate air stream into the combustion gases. The combustion system further includes a burnout zone downstream from the intermediate air zone, wherein the burnout zone is configured to inject an overfire air stream into the combustion gases, and at least one hybrid-boosted air injector within at least one of the intermediate air zone and the burnout zone. The at least one hybrid-boosted air injector is configured to substantially simultaneously inject a boosted air stream and a windbox air stream into the combustion gases.

13 Claims, 2 Drawing Sheets

SYSTEMS FOR STAGED COMBUSTION OF AIR AND FUEL

BACKGROUND OF THE INVENTION

The embodiments described herein relate generally to combustion systems, and more particularly to combustions systems that use staged fuel combustion.

During a typical combustion process within a furnace or boiler, for example, a flow of combustion gases, or flue gases, is generated. As used herein, the terms "flue gases" and "combustion gases" refer to the products of combustion including, but not limited to, carbon, carbon dioxide, carbon monoxide (CO), water, hydrogen, nitrogen, sulfur dioxide, chlorine, nitrogen oxides ($NO_X$), and/or mercury generated as a result of combusting fuels, such as solid and/or liquid fuels. Combustion gases may contain $NO_X$ in the form of a combination of nitric oxide (NO) and nitrogen dioxide ($NO_2$). Various technologies have been applied to combustion systems to minimize the emissions of $NO_X$, however, further improvements are needed.

At least some known furnaces use a staged combustion to reduce the production of at least some of the combustion products, such as nitrogen oxide ($NO_X$). For example, in a three-stage combustion process, fuel and air are combusted in a first stage, fuel in then introduced into the combustion gases in a second stage, and air is then supplied to the combustion gases in a third stage. More specifically, in the second stage, fuel is injected into the combustion gases, without combustion air, sufficient to form a sub-stoichiometric, or fuel rich zone. The term "fuel rich," as used herein, refers to a condition in which more than a stoichiometric amount of fuel available for reaction with oxygen ($O_2$) present in the available air, i.e., a stoichiometric ratio (SR) of less than about 1.0. The term "fuel lean," as used herein, refers to a condition in which less than a stoichiometric amount of fuel is available for reaction with oxygen ($O_2$) present in the available air, i.e., an SR of greater than about 1.0. In the second stage, at least some of the fuel combusts to produce hydrocarbon fragments that subsequently react with $NO_X$ that may have been produced in the first stage. As such, $NO_X$ present in the combustion gases may be reduced to atmospheric nitrogen in the second stage. In the third stage, air is injected to consume the carbon monoxide and unburnt hydrocarbons exiting the second stage. In known systems, the SR within the third stage is greater than approximately 1. Although three-staged combustion systems reduce an amount of $NO_X$ in the flue gases exiting the combustion system, further reduction in the amount of $NO_X$ in the flue gases is desirable.

BRIEF DESCRIPTION OF THE INVENTION

In one aspect, a combustion system for combusting air and fuel is provided. The combustion system includes a primary combustion zone configured to produce combustion gases from the air and the fuel and an intermediate air zone downstream from the primary combustion zone. The intermediate air zone is configured to inject an intermediate air stream into the combustion gases. The combustion system further includes a burnout zone downstream from the intermediate air zone, wherein the burnout zone is configured to inject an overfire air stream into the combustion gases, and at least one hybrid-boosted air injector within at least one of the intermediate air zone and the burnout zone. The at least one hybrid-boosted air injector is configured to substantially simultaneously inject a boosted air stream and a windbox air stream into the combustion gases.

In another aspect, a fuel-fired furnace is provided. The fuel-fired furnace includes a primary combustion zone configured to produce combustion gases, and an intermediate air zone downstream from the primary combustion zone. The intermediate air zone is configured to inject an intermediate air stream into the combustion gases. The furnace further includes a burnout zone downstream from the intermediate air zone, wherein the burnout zone is configured to inject an overfire air stream into the combustion gases, and at least one hybrid-boosted air injector within at least one of the intermediate air zone and the burnout zone. The at least one hybrid-boosted air injector is configured to substantially simultaneously inject a boosted air stream and a windbox air stream into the combustion gases.

In yet another aspect, a power generation system is provided. The power generation system includes at least one heat exchanger configured to transfer heat from combustion gases to a heat exchange medium, and a fuel-fired furnace upstream from the at least one heat exchanger. The fuel-fired furnace includes a primary combustion zone configured to produce the combustion gases, an intermediate air zone downstream from the primary combustion zone, wherein the intermediate air zone is configured to inject an intermediate air stream into the combustion gases, and a burnout zone downstream from the intermediate air zone. The burnout zone is configured to inject an overfire air stream into the combustion gases. The furnace further includes at least one hybrid-boosted air injector within at least one of the intermediate air zone and the burnout zone. The at least one hybrid-boosted air injector is configured to substantially simultaneously inject a boosted air stream and a windbox air stream into the combustion gases.

The embodiments described herein include at least an intermediate air zone for multi-staged combustion, at least one hybrid-boosted air injector for use in channeling a boosted air stream, and a windbox air stream into a combustion zone substantially simultaneously. The intermediate air zone described herein facilitates reducing $NO_X$ emissions, and the hybrid-boosted air injector described herein facilitates maintaining CO and loss-on-ignition (LOI) emissions as compared to known multi-stage combustion systems.

DETAILED DESCRIPTION OF THE INVENTION

The embodiments described herein include an exemplary four-stage combustion process that includes an intermediate air zone defined between a primary combustion zone and a reburning zone. The intermediate air zone can include at least one hybrid-boosted air injector for use in injecting a cooler, high velocity air stream, and a warmer, low velocity air stream into the combustion zone. Such a hybrid-boosted air injector can additionally, or alternatively, be included in a burnout zone downstream from the reburning zone. The hybrid-boosted air injector described herein facilitates near-field, and far-field, mixing within an air injection zone to facilitate enabling additional $NO_X$ to react within the combustion zone, as compared to known staged combustion systems.

Figure 1:
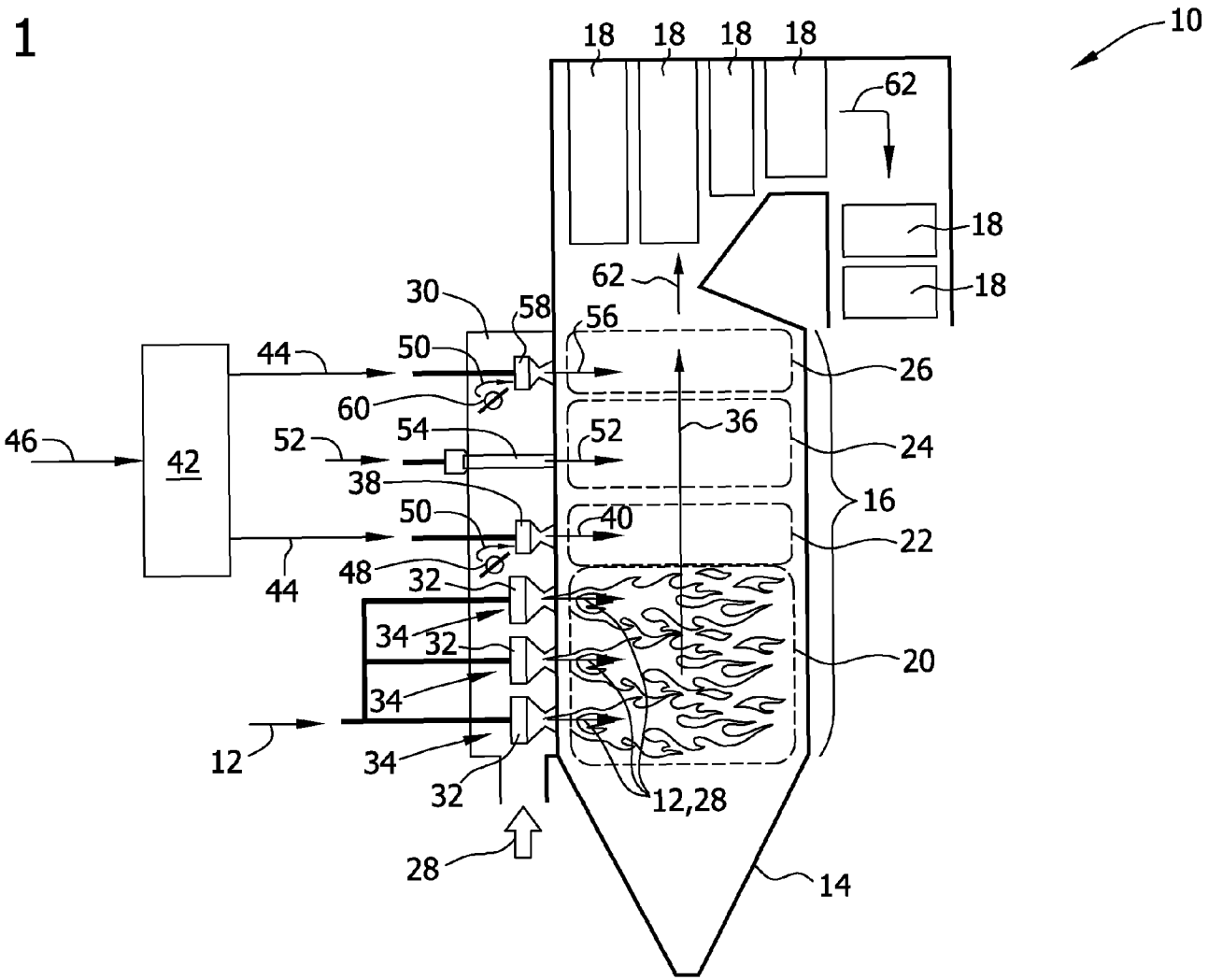
FIG. 1 is a schematic view of an exemplary power generation system.

FIG. 1 is a schematic view of an exemplary power generation system 10. In the exemplary embodiment, system 10 is supplied with fuel 12 in the form of coal. Alternatively, fuel 12 may be any other suitable fuel, such as, but not limited to, oil, natural gas, biomass, waste, or any other fossil or renewable fuel. In the exemplary embodiment, fuel 12 is supplied to system 10 from a main fuel source (not shown) to a boiler or a furnace 14. Specifically, in the exemplary embodiment, system 10 includes a fuel-fired furnace 14 that includes a combustion zone 16 and a plurality of heat exchangers 18. More specifically, in the exemplary embodiment, combustion zone 16 includes a primary combustion zone 20, an intermediate air zone 22, a reburning zone 24, and a burnout zone 26. In the exemplary embodiment, air 28 enters system 10 via a windbox 30.

In the exemplary embodiment, fuel 12 and air 28 are supplied to primary combustion zone 20 through one or more main injectors and/or burners 32. Moreover, in the exemplary embodiment, burners 32 are low-NOx burners. Main burners 32 receive a predetermined amount of fuel 12 and a predetermined quantity of air 28. Burners 32 may be tangentially arranged in each corner of furnace 14, wall-fired, or have any other suitable arrangement that enables furnace 14 to function as described herein. In the exemplary embodiment, burners 32 are oriented within furnace 14 such that a plurality of rows 34 of burners 32 is defined. Although only one burner 32 is illustrated in each row 34 in FIG. 1, each row 34 may include a plurality of burners 32. In the exemplary embodiment, after fuel 12 and air 28 are injected through burners 32, the fuel/air mixture is ignited in primary combustion zone 20 to produce combustion gases 36. In one embodiment, fuel 12 and air 28 are injected to create a fuel rich environment within primary combustion zone 20.

In the exemplary embodiment, intermediate air zone 22 is defined proximate to, and downstrem from, primary combustion zone 20. More specifically, in the exemplary embodiment, intermediate air zone 22 includes at least one hybrid-boosted intermediate air injector 38, as described in more detail below, for use in injecting an intermediate air stream 40. Hybrid-boosted intermediate air injector 38 is in flow communication with windbox 30 and a boosted air source 42. Boosted air source 42 produces a stream of boosted air 44 from air 46 entering boosted air source 42. Boosted air stream 44 has a relatively high velocity and a relatively low temperature, as compared to other fluid flows within system 10. In one embodiment, boosted air source 42 includes at least one fan and/or blower that accelerates a flow of air 46 to produce boosted air stream 44.

A damper 48 within windbox 30 regulates a stream of windbox air 50 through intermediate air injector 38. As described herein, windbox air stream 50 is air flowing through windbox 30 that may be pre-heated via heat transfer from furnace 14 and that is at a lower velocity than boosted air stream 44. In the exemplary embodiment, intermediate air stream 40 is a combination of windbox air stream 50 and boosted air stream 44 that is used to facilitate near-field and far-field mixing, as described in more detail below. Alternatively, intermediate air stream 40 may be windbox air stream 50 or boosted air stream 44 injected through hybrid-boosted intermediate air injector 38, depending on desired combustion characteristics within furnace 14.

Within intermediate air zone 22, intermediate air stream 40 is introduced into combustion gases 36 formed in primary combustion zone 20 to achieve a desired SR within intermediate air zone 22. More specifically, a quantity and/or rate of flow of intermediate air stream 40 is variably selected to facilitate achieving the desired SR. To control the rate of flow of intermediate air stream 40, a ratio of boosted air stream 44 to windbox air stream 50 is controlled via valves, such as damper 48, and/or the use of other suitable flow control devices. In one embodiment, the SR within intermediate air zone 22 is fuel lean. In an alternative embodiment, intermediate air zone 22 includes a conventional air injector that injects only boosted air or only windbox air into furnace 14, rather than, or in addition to, including a hybrid-boosted air injector.

In the exemplary embodiment, combustion gases 36 flow from intermediate air zone 22 towards reburning zone 24, wherein a predetermined amount of reburn fuel 52 is injected through a reburn fuel inlet 54. Although reburn fuel 52 and fuel 12 are described separately, reburn fuel 52 may be supplied from the same source (not shown) as fuel 12. In one embodiment, reburn fuel 52 is a different type of fuel than fuel 12. For example, fuel 12 may be, but is not limited to being, pulverized coal, and reburn fuel 52 may be natural gas. Alternatively, any suitable combination of fuel 12 and/or 52 that enables system 10 to function as described herein may be injected into furnace 14. In the exemplary embodiment, the amount of reburn fuel 52 injected is based on achieving a desired SR within reburning zone 24. More specifically, in the exemplary embodiment, the amount of reburn fuel 52 injected ensures a fuel-rich environment is created in reburning zone 24. In one embodiment, reburn fuel inlet 54 includes a hybrid-boosted air injection system in which reburn fuel inlet 54 injects reburn fuel 52, a boosted reburn air stream, and a windbox reburn air stream to achieve the desired SR within reburning zone 24.

From reburning zone 24, combustion gases 36 flow into burnout zone 26. In the exemplary embodiment, an overfire air stream 56 is injected into burnout zone 26 through at least one hybrid-boosted overfire air injector 58 included within burnout zone 26. Hybrid-boosted overfire air injector 58 is substantially similar to hybrid-boosted intermediate air injector 38. In the exemplary embodiment, hybrid-boosted overfire air injector 58 is in flow communication with boosted air source 42 and windbox 30. Alternatively, hybrid-boosted overfire air injector 58 is in flow communication with a boosted air source other than boosted air source 42. In the exemplary embodiment, a damper 60 within windbox 30 enables control of windbox air stream 50 flowing through hybrid-boosted overfire air injector 58. As such, in the exemplary embodiment, overfire air stream 56 is a combination of windbox air stream 50 and boosted air stream 44 to facilitate near-field and far-field mixing within combustion zone 16. Alternatively, overfire air stream 56 is either windbox air stream 50 or boosted air stream 44 injected through hybrid-boosted overfire air injector 58, depending on desired combustion characteristics within furnace 14.

In the exemplary embodiment, a predetermined quantity and/or rate of flow of overfire air stream 56 is injected into burnout zone 26 to achieve a desired SR within burnout zone 26. More specifically, the quantity and/or rate of flow of overfire air stream 56 supplied is selected, as described above, to achieve a desired SR within burnout zone 26. More specifically, in the exemplary embodiment, the quantity and rate of flow of overfire air stream 56 supplied is selected to facilitate completing combustion of fuel 12 and reburn fuel 52, which facilitates reducing pollutants in combustion gases 36, such as, but not limited to, nitrogen oxides, $NO_x$, and/or carbon monoxide, CO.

In an alternative embodiment, burnout zone 26 includes a conventional air injector that injects only boosted air or only windbox air into furnace 14, rather than including a hybrid-boosted air injector. More specifically, it should be understood that intermediate air zone 22 and/or burnout zone 26 includes a hybrid-boosted air injector, although both intermediate air zone 22 and burnout zone 26 are described herein as including a hybrid-boosted air injector.

In the exemplary embodiment, combustion gases 36 exit combustion zone 16 as flue gases 62 enter heat exchangers 18. Heat exchangers 18 transfer heat from flue gases 62 to a heat transfer medium, such as a fluid (not shown), in a known manner. More specifically, the heat transfer heats the medium, such as, for example, heating water to generate steam. The heated medium, for example, the steam, is used to generate power via known power generation methods and systems (not shown), such as, for example, via a steam turbine (not shown). Alternatively, heat exchangers 18 transfer heat from flue gases 62 to a fuel cell (not shown) used to generate power. Power may be supplied to a power grid (not shown) or any other suitable power outlet.

During operation of system 10, fuel 12, air 28, intermediate air stream 40, reburn fuel 52, and/or overfire air stream 56 are injected and combusted in combustion zone 16 to form flue gases 62 that are channeled from combustion zone 16 through heat exchangers 18. More specifically, in the exemplary embodiment, flows of air 28, 40, and/or 56 and/or fuel 12 and/or 52 entering combustion zone 16 are controlled, at least in quantity and/or flow rate, to form flue gases 62 that have a reduced $NO_X$ content as compared to combustion system that do not include intermediate air zone 22 and/or hybrid-boosted air injectors 38 and/or 58. Furthermore, in the exemplary embodiment, hybrid-boosted air injectors 38 and/or 58 are controlled to inject boosted air stream 44, windbox air stream 50, and/or a combination of boosted air stream 44 and windbox air stream 50 into combustion zone 16.

Figure 2:
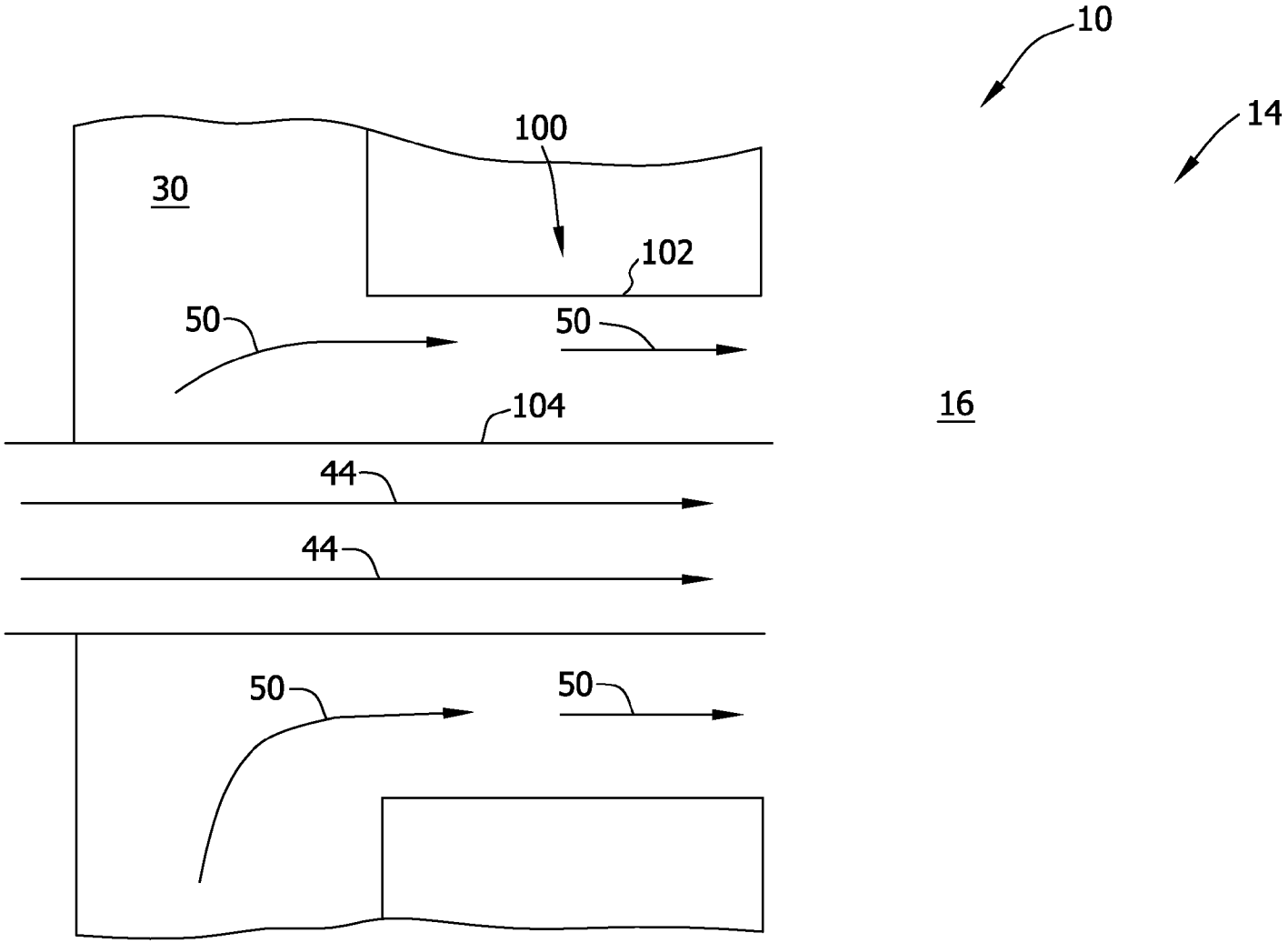
FIG. 2 is a schematic view of an exemplary hybrid-boosted air injector that may be used with the power generation system shown in FIG. 1.

FIG. 2 is a schematic view of an exemplary hybrid-boosted air injector 100 that may be used with power generation system 10 as hybrid-boosted intermediate air injector 38 (shown in FIG. 1) and/or as hybrid-boosted overfire air injector 58 (shown in FIG. 1). In the exemplary embodiment, hybrid-boosted air injector 100 includes a housing 102 and a tube 104 that penetrates through housing 102. Housing 102 is in flow communication with windbox 30 to enable windbox air stream 50 to be injected into combustion zone 16. Tube 104 extends through windbox 30 to boosted air source 42 (shown in FIG. 1) such that tube 104 is in flow communication with boosted air source 42. Tube 104 injects boosted air stream 44 into combustion zone 16.

During operation of hybrid-boosted air injector 100, depending on desired combustion characteristics, windbox air stream 50 is channeled through housing 102, about tube 104, to combustion zone 16, and boosted air stream 44 is channeled from boosted air source 42, through tube 104, to combustion zone 16. As such, hybrid-boosted air injector 100 simultaneously injects windbox air stream 50 and boosted air stream 44 into combustion zone 16. System 10 includes any suitable device for use in controlling windbox air stream 50 through housing 102 and/or boosted air stream 44 through tube 104. In a particular embodiment, through controlling the flows, at least one flow of air is prevented from flowing through hybrid-boosted air injector 100.

The above-described embodiments combine hybrid-boosted air injection and multi-stage reburn technologies. The multi-stage reburn described herein, unlike traditional reburn, applies intermediate staged air between a primary combustion zone and a reburning zone. The intermediate staged air injection facilitates reducing an initial $NO_X$ quantity flowing into the reburning zone to improve overall $NO_X$ reduction performance between about 20% to about 30% as compared to known reburn technologies. The hybrid-boosted air injection technology described herein is applied to the intermediate air zone and/or a burnout zone to facilitate minimizing CO and LOI emissions. More specifically, the hybrid-boosted air injection, which includes a cooler, high velocity air stream and a warmer, low velocity air stream, reduces an impact on boiler heat loss efficiency relative to known boosted air injection, which includes only a cooler, high velocity air stream. The mixing of warmer and cooler air streams also reduces boost air equipment and/or parasitic power costs. The above-described hybrid-boosted air injection can also be used as a carrier medium for reburn fuel injection to improve mixing performance with combustion gases. Accordingly, the above-described system facilitates providing an effective means for reducing $NO_X$ emissions while maintaining, or reducing, CO and LOI emissions relative to other staging technologies.

Further, the combustion system described herein facilitates providing $NO_X$ emissions control requirements, currently and possibly in the future, with minimal impact on baseline CO and/or LOI emissions. More specifically, the intermediate stage air leads to fuel rich conditions, or sub-stoichiometric conditions, in or proximate the primary combustion zone. As such, the intermediate air injection described herein increases LOI and/or CO emissions while reducing $NO_X$ flowing into the reburning zone. Further, the hybrid-boosted air injection facilitates restoring the CO and LOI to near baseline conditions when $NO_X$ emissions are reduced by improving control over near-field and far-field intermediate air and/or overfire air mixing. The system described herein facilitates meeting, or exceeding, $NO_X$ emissions of about 200 milligrams per normal cubic meter ($mg/Nm^3$) while holding LOI to levels that enable the sale of the waste ash. The above-described intermediate air injection and hybrid-boosted air injection can be combined with selective non-catalytic reduction system (SNCR) to facilitate attaining $NO_X$ emission levels at, or below, about 0.1 pounds per million British thermal units (lb/MMBtu). Accordingly, the above-described combustion system can be used in a layered-$NO_X$ emissions package to meet, or exceed, $NO_X$ emissions regulations while having a minimal impact on LOI and/or CO emissions. Further, the system described herein costs significantly less than systems using selective catalytic reduction (SCR), which is currently classified as the Best Available Control Technology (BACT). In one embodiment, a layered technology package that includes intermediate air reburn and/or hybrid-boosted air injection and SNCR can provide nearly as much overall $NO_X$ control as SCR.

Exemplary embodiments of methods and systems for staged combustion of air and fuel are described above in detail. The methods and systems are not limited to the specific embodiments described herein, but rather, components of systems and/or steps of the method may be utilized independently and separately from other components and/or steps described herein. For example, the methods may also be used in combination with other fuel combustion systems and methods, and are not limited to practice with only the power generation systems and methods as described herein. Rather, the exemplary embodiment can be implemented and utilized in connection with many other fuel combustion applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel-fired furnace comprising:

a primary combustion zone configured to produce combustion gases;

an intermediate air zone downstream from said primary combustion zone, said intermediate air zone configured to inject an intermediate air stream into the combustion gases;

a reburning zone downstream from said intermediate air zone such that said intermediate air zone is defined between said primary combustion zone and said reburning zone, said reburning zone comprising an injector configured to inject fuel into the combustion gases;

a burnout zone downstream from said reburning zone, said burnout zone configured to inject an overfire air stream into the combustion gases;

at least one burner within said primary combustion zone configured to inject a fuel stream and a windbox air stream into said primary combustion zone;

at least one hybrid-boosted intermediate air injector within said intermediate air zone, said at least one hybrid-boosted air intermediate injector configured to substantially simultaneously inject a boosted air stream and a windbox air stream into the combustion gases; and at least one hybrid-boosted overfire air injector within said burnout zone, said at least one hybrid-boosted overfire air injector configured to substantially simultaneously inject the boosted air stream and the windbox air stream into the combustion gases.

2. A fuel-fired furnace in accordance with claim 1, wherein said reburning zone injector is further configured to inject a boosted reburn air stream and a windbox reburn air stream into the combustion gases.

3. A fuel-fired furnace in accordance with claim 1, wherein said at least one hybrid-boosted intermediate air injector comprises:

a housing configured to channel said windbox air stream into said primary combustion zone; and a tube extending through said housing, said tube configured to channel said boosted air stream into said primary combustion zone.

4. A fuel-fired furnace in accordance with claim 1 further comprising a windbox in flow communication with said at least one hybrid-boosted intermediate air injector.

5. A fuel-fired furnace in accordance with claim 4, wherein said windbox comprises at least one damper for controlling the windbox air stream injected through said at least one hybrid-boosted intermediate air injector.

6. A combustion system for combusting air and fuel, said combustion system comprising:

a primary combustion zone configured to produce combustion gases from the air and the fuel;

an intermediate air zone downstream from said primary combustion zone, said intermediate air zone configured to inject an intermediate air stream into the combustion gases;

a reburning zone downstream from said intermediate air zone such that said intermediate air zone is defined between said primary combustion zone and said reburning zone, said reburning zone comprising an injector configured to inject fuel into the combustion gases;

a burnout zone downstream from said reburning zone, said burnout zone configured to inject an overfire air stream into the combustion gases;

at least one burner within said primary combustion zone configured to inject a fuel stream and a windbox air stream into said primary combustion zone;

at least one hybrid-boosted intermediate air injector within said intermediate air zone, said at least one hybrid-boosted intermediate air injector configured to substantially simultaneously inject a boosted air stream and a windbox air stream into the combustion gases; and at least one hybrid-boosted overfire air injector within said burnout zone, said at least one hybrid-boosted overfire air injector configured to substantially simultaneously inject the boosted air stream and the windbox air stream into the combustion gases.

7. A combustion system in accordance with claim 6, wherein said reburning zone injector is further configured to inject a boosted reburn air stream and a windbox reburn air stream into the combustion gases.

8. A combustion system in accordance with claim 6 further comprising:

a windbox in flow communication with said at least one hybrid-boosted intermediate air injector, said windbox providing said windbox air stream to said at least one hybrid-boosted intermediate air injector; and a boosted air source in flow communication with said at least one hybrid-boosted intermediate air injector, said boosted air source configured to channel said boosted air stream to said at least one hybrid-boosted intermediate air injector.

9. A combustion system in accordance with claim 8, wherein said at least one hybrid-boosted intermediate air injector comprises:

a housing in flow communication with said windbox, said housing configured to channel said windbox air stream into said primary combustion zone; and a tube in flow communication with said boosted air source and extending through said housing, said tube configured to channel said boosted air stream into said primary combustion zone from said boosted air source.

10. A power generation system comprising:

at least one heat exchanger configured to transfer heat from combustion gases to a heat exchange medium; and a fuel-fired furnace upstream from said at least one heat exchanger, said fuel-fired furnace comprising:

a primary combustion zone configured to produce the combustion gases;

an intermediate air zone downstream from said primary combustion zone, said intermediate air zone configured to inject an intermediate air stream into the combustion gases;

a reburning zone downstream from said intermediate air zone such that said intermediate air zone is defined between said primary combustion zone and said reburning zone, said reburning zone comprising an injector configured to inject fuel into the combustion gases;

a burnout zone downstream from said reburning zone, said burnout zone configured to inject an overfire air stream into the combustion gases;

at least one burner within said primary combustion zone configured to inject a fuel stream and a windbox air stream into said primary combustion zone;

at least one hybrid-boosted intermediate air injector within said intermediate air zone, said at least one hybrid-boosted intermediate air injector configured to substantially simultaneously inject a boosted air stream and a windbox air stream into the combustion gases; and at least one hybrid-boosted overfire air injector within said burnout zone, said at least one hybrid-boosted overfire air injector configured to substantially simultaneously inject the boosted air stream and the windbox air stream into the combustion gases.

11. A power generation system in accordance with claim 10 further comprising a windbox in flow communication with said at least one hybrid-boosted intermediate air injector, said windbox configured to supply said windbox air stream to said at least one hybrid-boosted air injector.

12. A power generation system in accordance with claim 10 further comprising a boosted air source in flow communication with said at least one hybrid-boosted intermediate air injector, said boosted air source configured to channel said boosted air stream to said at least one hybrid-boosted intermediate air injector.

13. A power generation system in accordance with claim 10, wherein said at least one hybrid-boosted intermediate air injector comprises:

a housing in flow communication with a windbox to channel said windbox air stream into said fuel-fired furnace; and a tube extending through said housing, said tube in flow communication with a boosted air source to channel said boosted air stream into said fuel-fired furnace.

* * * * *